US007109984B2

(12) United States Patent
Moon

(10) Patent No.: US 7,109,984 B2
(45) Date of Patent: Sep. 19, 2006

(54) LIQUID CRYSTAL DISPLAY HAVING GRAY VOLTAGES WITH VARYING MAGNITUDES AND DRIVING METHOD THEREOF

(75) Inventor: Seung-Hwan Moon, Seoul (KR)

(73) Assignee: Samsung Electronics Co., Ltd., (KR)

( * ) Notice: Subject to any disclaimer, the term of this patent is extended or adjusted under 35 U.S.C. 154(b) by 419 days.

(21) Appl. No.: 10/255,903

(22) Filed: Sep. 25, 2002

(65) Prior Publication Data

US 2003/0058235 A1 Mar. 27, 2003

(30) Foreign Application Priority Data

Sep. 27, 2001 (KR) ..... 2001-59868

(51) Int. Cl.
*G09G 3/36* (2006.01)
*G09G 5/00* (2006.01)

(52) U.S. Cl. ..... 345/212; 345/89; 345/95; 345/210; 345/690

(58) Field of Classification Search ..... 345/76–98, 345/204–215, 690–699; 245/690–699
See application file for complete search history.

(56) References Cited

U.S. PATENT DOCUMENTS 5,625,387 A * 4/1997 Moon ..... 345/211
5,926,157 A * 7/1999 Moon ..... 345/89
5,945,970 A * 8/1999 Moon et al. ..... 345/92
6,535,189 B1 * 3/2003 Akiyama et al. ..... 345/87
6,600,470 B1 * 7/2003 Tsuda ..... 345/89
6,727,872 B1 * 4/2004 Pfeiffer et al. ..... 345/87
6,762,742 B1 * 7/2004 Moon et al. ..... 345/102
2002/0011978 A1 * 1/2002 Yamazaki et al. ..... 345/87

FOREIGN PATENT DOCUMENTS

EP 1 220 193 A2 7/2002

* cited by examiner

*Primary Examiner*—Vijay Shankar
(74) *Attorney, Agent, or Firm*—Cantor Colburn LLP

(57) ABSTRACT

A liquid crystal display ("LCD") having a plurality of gray voltages with varying magnitudes and a driving method thereof. An LCD includes a reference voltage generator changing level of a supply voltage based on a first signal to generate a reference voltage. The first signal varies depending on the surrounding brightness of the LCD, the brightness of the on-screen images of the LCD, and user's manipulation. The LCD also includes a gray voltage generator generating a plurality of gray voltages with magnitudes varying dependent on the magnitude of the reference voltage and a predetermined voltage such as a ground voltage. The LCD further includes a plurality of gate lines transmitting a plurality of gate signals, a plurality of data lines transmitting the gray voltages, and a plurality of pixels. Each pixel has a switching element connected to one of the gate lines and one of the data lines and transmitting the gray voltages to the pixels under the control of the gate signal. The LCD includes a gate driver supplying the gate signals to the gate lines and a data driver selecting the gray voltages based on gray data from an external source to supply to the pixels via the data lines.

8 Claims, 9 Drawing Sheets

LIQUID CRYSTAL DISPLAY HAVING GRAY VOLTAGES WITH VARYING MAGNITUDES AND DRIVING METHOD THEREOF

BACKGROUND OF THE INVENTION (a) Field of the Invention

The present invention relates to a liquid crystal display and a driving method thereof, and particularly to a liquid crystal display having a plurality of gray voltages with varying magnitudes and a driving method thereof.

(b) Description of the Related Art

A typical liquid crystal display ("LCD") includes a pair of panels with field-generating electrodes and a liquid crystal layer with dielectric anisotropy interposed therebetween. The liquid crystal layer is applied with electric field generated by the field-generating electrodes, and the transmittance of light passing through the liquid crystal layer is adjusted by controlling the magnitudes of voltages applied to the field-generating electrodes, thereby obtaining desired images.

Generally, a dark image of a display is much unclear at a bright place than at a dark place. This is because human eyes hardly recognize the brightness difference between portions of a dark image at a bright place. Since the brightness difference between low grays of a conventional LCD is small, the visibility of LCD images, specifically for a motion picture, is inferior to that of other kinds of displays.

In order to improve brightness difference between low grays, it is suggested to improve a light source of an LCD such as a backlight unit. For example, the light intensity of lamps of the backlight unit is increased, the number of the lamps is increased, or several various prism sheets are provided in the backlight unit. However, these increase the power consumption, the weight and the cost of the LCD.

In addition, it is hard to increase the light intensity of the backlight unit twice, three times or more than the normal intensity, and even though the intensity would increase, the visibility is not so much improved in comparison with the increasing rate of the intensity of the backlight unit. Furthermore, a bright screen makes users feel fatigue soon.

SUMMARY OF THE INVENTION

A liquid crystal display is provided, which includes: a reference voltage generator changing level of a first predetermined voltage based on a first signal to generate a reference voltage, the first signal varying depending on one of brightness of surroundings of the liquid crystal display, brightness of on-screen images of the liquid crystal display, and a user's manipulation; and a gray voltage generator generating a plurality of gray voltages with magnitudes depending on a magnitude of the reference voltage and a second predetermined voltage.

It is preferable that the liquid crystal display further includes: a plurality of first signal lines, a plurality of second signal lines and a plurality of pixels connected to the first and the second signal lines; and a first driver selecting the gray voltages based on gray data from an external source to supply to the pixels via the first signal lines. It is also preferable that the liquid crystal display further includes a second driver supplying second signals to the second signal lines, each pixel including a switching element connected to one of the first signal lines and one of the second signal lines and transmitting the gray voltages to the pixels under the control of the second signals.

The reference voltage generator preferably includes a first voltage divider dropping level of a third predetermined voltage for turning on the switching elements to generate the first signal.

According to an embodiment of the present invention, the reference voltage generator further includes a light sensor sensing the brightness of the surroundings of the liquid crystal display and generating a signal depending on the sensed brightness.

According to another embodiment of the present invention, the first voltage divider includes a variable resistor with resistance adjustable by a user.

According to an embodiment of the present invention, the liquid crystal display further includes a signal generator determining the brightness of the on-screen images of the liquid crystal display and generating a signal depending on the brightness. The reference voltage generator preferably further includes an amplifier amplifying the signal, and a second voltage divider reducing level of the first predetermined voltage, and the amplification of the signal is performed based on the level-reduced first predetermined voltage.

According to an embodiment of the present invention, the signal generator includes: a square wave generator calculating an average value of gray data from an external source for a horizontal period and generating a duty signal depending on the average value of the gray data; and an analog converter analogue-converting the duty signal from the square wave generator into the first signal.

According to an embodiment of the present invention, the square wave generator includes: a data converter assigning a weight to at least one gray datum in each group of the gray data; a first adder adding the gray data in each group of the gray data to output as first sums; a second adder adding the first sums for one horizontal period to output as a second sum; a divider dividing the second sum by the number of the gray data in each group of the gray data and extracting top bits from the second sum divided by the number of the gray data in each group of the gray data to output as first data; a counter down-counting the first data; and a duty signal generator generating a square wave having a duty on the basis of the down-counted number of the first data.

According to an embodiment of the present invention, the analogue converter includes: a transistor turned on and off in response to the duty signal; and a voltage control unit generating the first signal analogue-converted in response to analogue voltages leveled up an down depending on the turning on and off of the transistor. The first signal is preferably determined by time constant of the voltage control unit, and is proportional to duty and pulse count of the duty signal.

The liquid crystal display preferably further includes a common voltage generator generating a common voltage to be applied to the pixels, based on the reference voltage, and the gray voltage generator preferably includes a voltage divider connected between the reference voltage and the second predetermined voltage. It is preferable that the voltage divider includes first and second series of resistors connected in series, and the first series of resistors is connected to the reference voltage while the second series of resistors is connected to the second predetermined voltage, the magnitudes of the gray voltages determined by magnitudes of the reference voltage and the second predetermined voltage and resistances of the first and the second series of resistors the reference voltage generator preferably includes a transistor having a first terminal coupled to the first signal, a second terminal coupled to the first predetermined voltage, and a third terminal outputting the reference voltage.

A method of driving a liquid crystal display having a plurality of gate lines, a plurality of data lines, and a plurality of pixels including switching elements connected to the gate lines and the data lines is provided, which includes: sensing brightness level of surroundings of the liquid crystal display to generate a first signal; changing a predetermined voltage to generate a second signal on the basis of the first signal; generating a plurality of gray voltages with magnitudes varying dependent on the second signal; providing scan signals for the gate lines to turn on the switching elements; and converting gray data from an external source into corresponding gray voltages to providing the corresponding gray voltages to the pixels via the data lines and the switching elements.

A method of driving a liquid crystal display having a plurality of gate lines, a plurality of data lines, and a plurality of pixels including switching elements connected to the gate lines and the data lines is provided, which includes: determining brightness level of on-screen images of the liquid crystal display based on gray data from an external source to generate a first signal; changing level of a predetermined voltage to generate a second signal on the basis of the first signal; generating a plurality of gray voltages with values varying depending on the second signal; providing scan signals for the gate lines to turn on the switching elements; and converting the gray data into corresponding gray voltages to providing the corresponding gray voltages to the pixels via the data lines and the switching elements.

According to an embodiment of the present invention, the determination includes: calculating an average value of the gray data for a horizontal period; generating a duty signal depending on the average value of the gray data; and analogue-converting the duty signal into the first signal.

According to an embodiment of the present invention, the calculation of the average value includes: adding the gray data in respective groups of the gray data to output as first sums; adding the first sums for one horizontal period to output as a second sum; dividing the second sum by the number of the gray data in each group of the gray data; extracting top bits from the second sum divided by the number of the gray data in each group of the gray data to output as first data; down-counting the first data; and generating a square wave having a duty on the basis of the down-counted number of the first data.

BRIEF DESCRIPTION OF THE DRAWINGS

The above and other objects and advantages of the present invention will become more apparent by describing in detail preferred embodiments thereof with reference to the accompanying drawings in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout. Then, liquid crystal displays and methods of driving the same according to embodiments of the present invention will be described with reference to the drawings.

Figure 1:
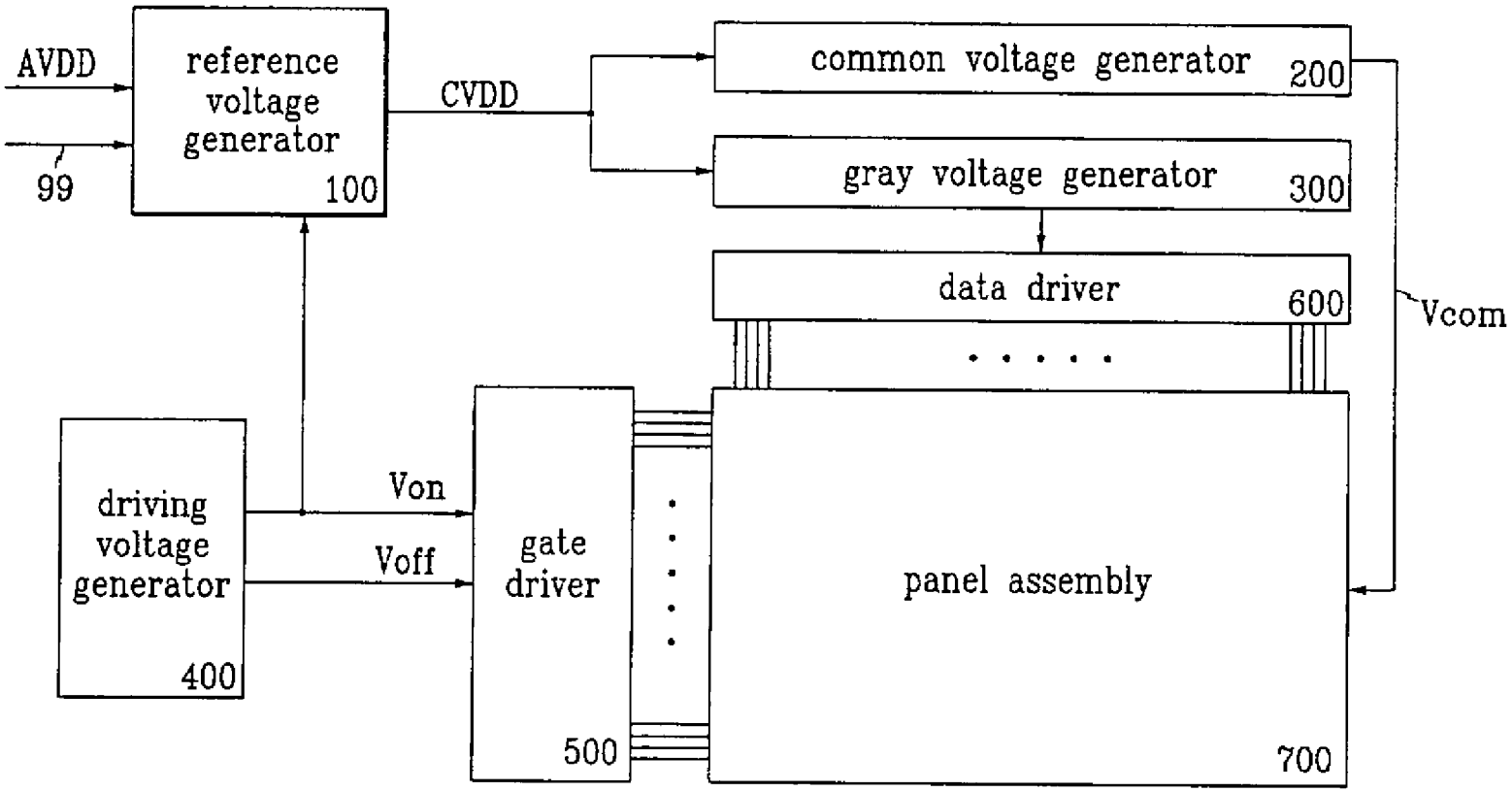
FIG. 1 is a schematic block diagram of an LCD according to an embodiment of the present invention.

FIG. 1 is a schematic block diagram of an LCD according to an embodiment of the present invention.

With reference to FIG. 1, an LCD according to an embodiment of the present invention includes a reference voltage generator 100, a common electrode voltage ("common voltage") generator 200, a gray voltage generator 300, a driving voltage generator 400, a gate driver 500, a data driver 600, and an LCD panel assembly 700.

The panel assembly 700 includes a plurality of gate lines (not shown), a plurality of data lines (not shown), and a plurality of pixels (not shown) arranged in a matrix. Each pixel includes a liquid crystal capacitor (not shown), a switching element such as a thin film transistor ("TFT") (not shown) and preferably a storage capacitor (not shown). Each TFT has a gate connected to one of the gate lines, a source connected to one of the data lines and a drain connected to the liquid crystal capacitor and the storage capacitor. The liquid crystal capacitor is connected between the TFT and a common voltage.

The driving voltage generator 400 generates a gate-on voltage Von and a gate-off voltage Voff to provide for the gate driver 500, and at the same time, to provide the gate-on voltage Von for the reference voltage generator 100.

The reference voltage generator 100 changes the level of a supply voltage AVDD provided by a DC/DC converter (not shown) based on the gate-on voltage Von from the driving voltage generator 400 and a signal from an external source, to generate a reference voltage CVDD to provide for both the common voltage generator 200 and the gray voltage generator 300.

Here, the signal 99 from the external source may be a light signal from surroundings of the LCD, a signal generated by a users' manipulation, or a signal varying dependent on brightness of on-screen images.

The common voltage generator 200 adjusts the level of the reference voltage CVDD to generate and provide a common voltage Vcom for the liquid crystal capacitors of the panel assembly 700.

The gray voltage generator 300 generates a plurality of gray voltages with magnitudes depending on the reference voltage CVDD to provide for the data driver 600.

The gate driver 500 applies the gate-on voltage and the gate-off voltage to the gate lines of the panel assembly 700 according to control signals from a signal controller (not shown) to turn on and off the TFTs.

The data driver 600 selects the gray voltages based on gray data from the signal controller to provide for the data lines of the panel assembly 700.

According to an embodiment of the present invention, an LCD increases the brightness of the grays, particularly of the lower grays in a range between the first gray to the sixteenth grays among total sixty four grays, when the brightness of the surrounding of the LCD becomes low, and vice versa. For example, in a normally black mode, the magnitudes of the gray voltages with respect to the common voltage increases when the surroundings of the LCD becomes dark, and vice versa. On the contrary, for a normally white mode LCD, the magnitudes of the gray voltages with respect to the common voltage decreases when the surroundings of the LCD becomes dark, and vice versa.

Alternatively, a user manipulates to decrease or increase the levels of gray voltages for improving the visibility. Another alternative is to adjust the levels of gray voltages depending on the brightness of on-screen images of the LCD.

Now, embodiments for adjusting the levels of the gray voltages will be described in detail.

Figure 2:
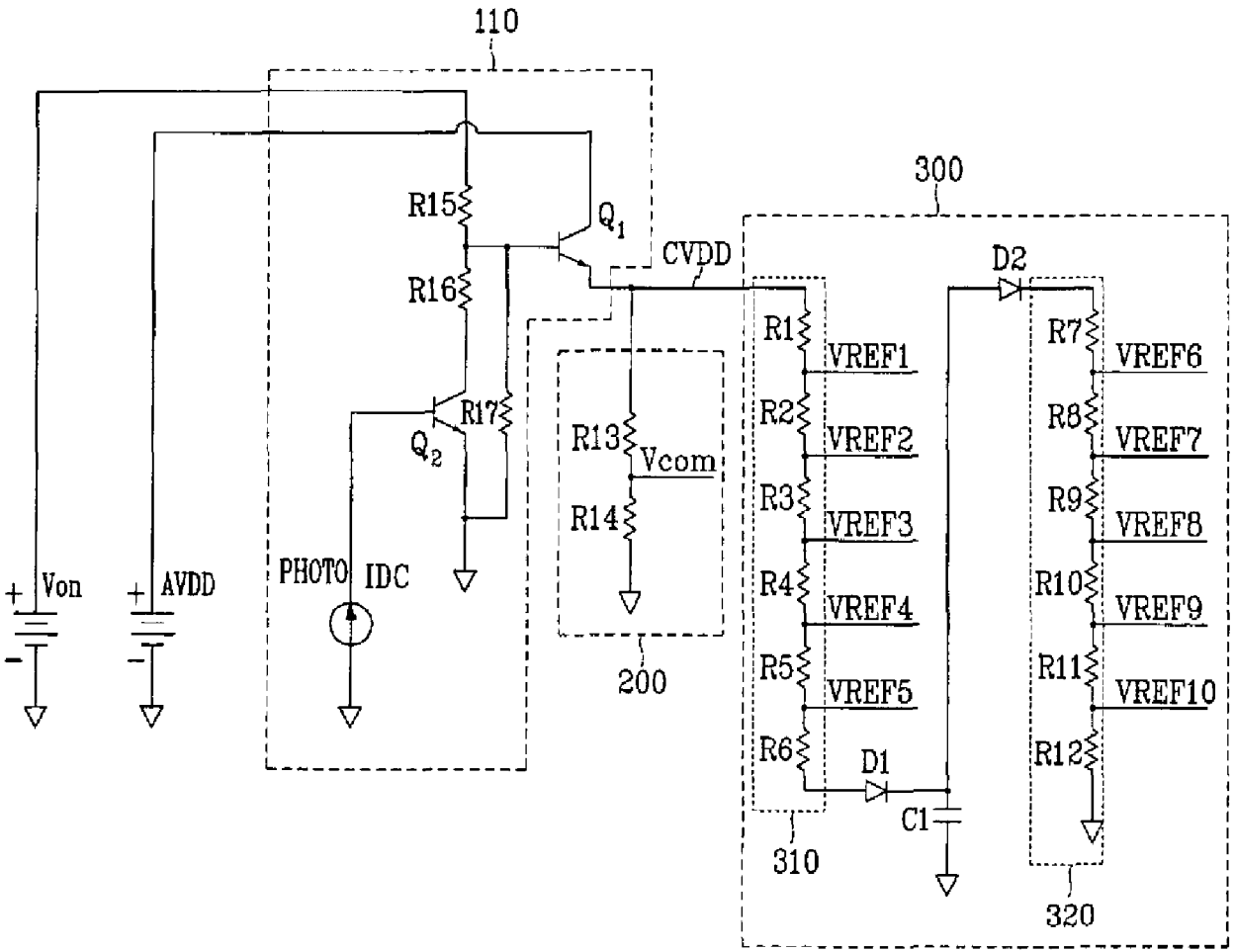
FIG. 2 is a circuit diagram of a gray voltage generator of an LCD according to an embodiment of the present invention.

FIG. 2 is a circuit diagram of an exemplary LCD according to an embodiment of the present invention, which adjusts the levels of gray voltages depending on the brightness level of surroundings of the LCD.

With reference to FIG. 2, an LCD according to one embodiment of the present invention includes a reference voltage generator 110 automatically sensing the brightness level of surroundings to generate a reference voltage CVDD based on a gate-on voltage Von and a supply voltage AVDD, a common voltage generator 200 generating a common voltage Vcom on the basis of the reference voltage CVDD, and a gray voltage generator 300 generating a plurality of gray voltages VREF1–VREF10 on the basis of the reference voltage CVDD.

The reference voltage generator 110 includes a photo transistor represented as a photocurrent source PHOTO_IDC and a transistor Q2 with a base connected to the photocurrent source PHOTO_IDC, a voltage divider including a pair of resistors R15 and R16 connected in series between a gate-on voltage Von and a collector of the transistor Q2, a resistor R17 connected between an emitter of the transistor Q2 and the voltage divider R15 and R16, and a transistor Q1 with a base connected to the voltage divider R15 and R16, a collector connected to the supply voltage AVDD and an emitter connected to the common voltage generator 200 and the gray voltage generator 300.

The common voltage generator 200 includes a voltage divider including a pair of resistors R13 and R14 connected in series between the reference voltage CVDD or the output of the reference voltage generator 110 and a predetermined voltage such as a ground voltage. The common voltage, the output voltage of the common voltage generator 200 is the voltage of a node between the resistors R13 and R14.

The gray voltage generator 300 includes a positive voltage generator 310 including a series of resistors R1–R6, a negative voltage generator 320 including a series of resistors R7–R12, a pair of diodes D1 and D2 connected in series and forward biased from the positive voltage generator 310 to the negative voltage generator 320, and a capacitor C1 connected between a node between the diodes D1 and D2 and a predetermined voltage such as the ground voltage. The series of resistors R1–R12 connected in series between the output of the reference voltage generator 110 and a predetermined voltage such as the ground voltage. The gray voltages, the outputs VREF1–VREF10 of the positive and the negative voltage generators 310 and 320 are connected to nodes between the resistors R1–R6 and R7–R12, respectively.

In operation, the photocurrent source PHOTO_IDC generates a photocurrent in response to light of surroundings of the LCD to provide for the base of the transistor Q2. The transistor Q2 varies its collector current proportional to the base current. The voltage divider R15 and R16 reduces the level of the gate-on voltage Von depending on the collector current of the transistor Q2 to provide for the base of the transistor Q1. The transistor Q1 reduces the supply voltage AVDD depending on its base voltage to output through its emitter, and the output voltage of the transistor Q1 is provided as the reference voltage CVDD for the common voltage generator 200 and the gray voltage generator 300.

The magnitude of the photocurrent from the photocurrent source PHOTO_IDC is proportional to the light intensity of the surroundings of the LCD, and the magnitude of the collector current of the transistor Q2 is proportional to the magnitude of its base current. The magnitude of the output voltage of the voltage divider R15 and R16, i.e., the magnitude of the base voltage of the transistor Q1 is inversely proportional to the collector current of the transistor Q2, and the magnitude of the emitter voltage of the transistor Q1 is approximately proportional to the magnitude of its base voltage. Accordingly, the reference voltage CVDD is approximately inversely proportional to the light intensity of the surroundings of the LCD.

As a result, the reference voltage CVDD becomes lower as the light intensity of the surroundings becomes stronger, thereby reducing the magnitudes of the gray voltages.

Figure 3:
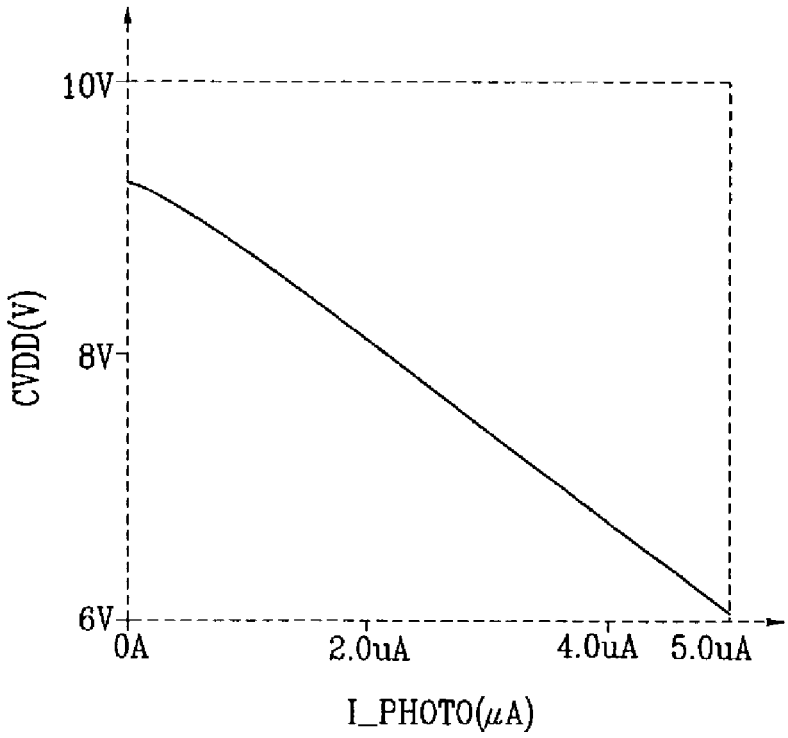
FIG. 3 illustrates a reference voltage CVDD as function of photocurrent according to an embodiment of the present invention.

FIG. 3 is a graph showing a reference voltage CVDD as function of the photocurrent I_PHOTO in an LCD shown in FIG. 2, which was obtained by the simulation using PSPICE.

It can be understood from the curve shown in FIG. 3 that the reference voltage CVDD is inversely proportional to the photocurrent I_PHOTO. The gradient of the curve shown in FIG. 3 is controlled by adjusting the transmittance of a photo window of the photo transistor.

Figure 4:
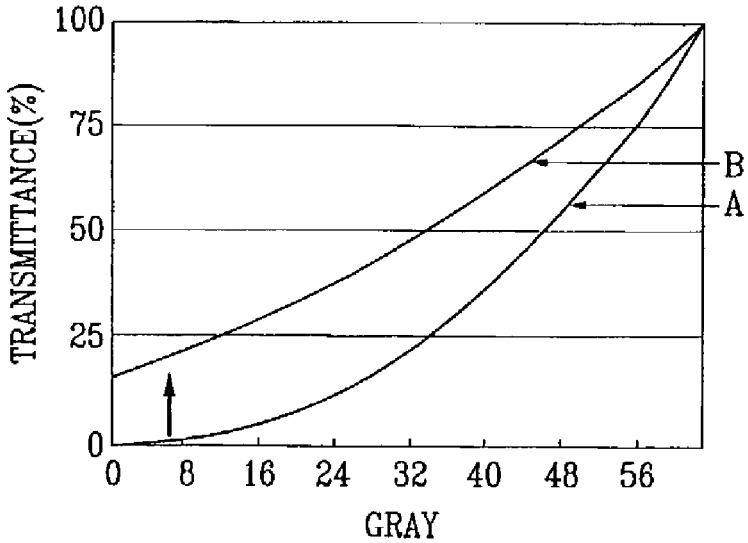
FIG. 4 illustrates a conventional gamma curve and an adjusted gamma curve according to an embodiment of the present invention.

FIG. 4 illustrates gamma curves of an LCD according to an embodiment of the present invention for y=2.2.

As shown in FIG. 4, the gamma curve according to an embodiment of the present invention goes toward the curve B as the surroundings become dark, while the gamma curve goes toward the curve A as the surroundings become bright. That is, the brightness for the grays, especially for the lower grays, increases when the surroundings become dark, while the brightness decreases when the surroundings become bright.

Figure 5:
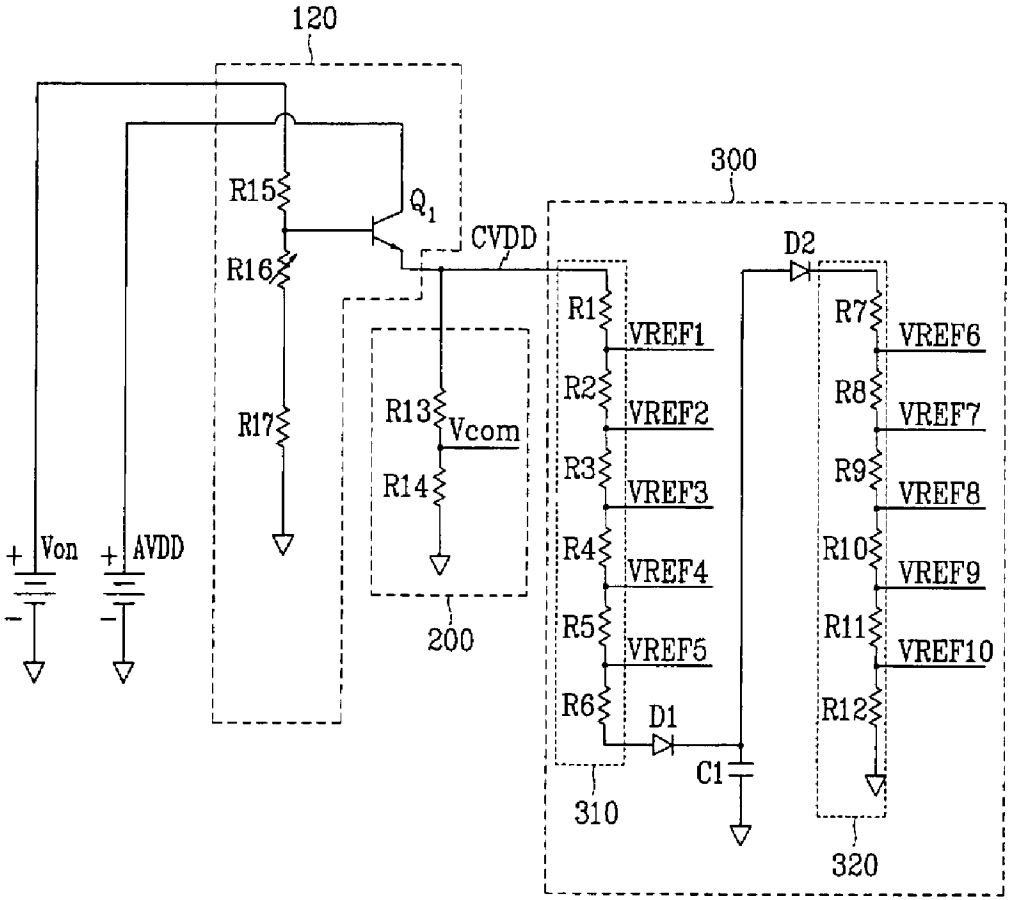
FIG. 5 is a circuit diagram of a gray voltage generator of an LCD according to another embodiment of the present invention.

FIG. 5 is a circuit diagram of an exemplary LCD according to another embodiment of the present invention, in which the levels of gray voltages can be adjusted by a user.

With reference to FIG. 5, an LCD according to another embodiment of the present invention includes a reference voltage generator 120 generating a reference voltage CVDD, a common voltage generator 200 generating a common voltage Vcom on the basis of the reference voltage CVDD, and a gray voltage generator 300 generating a plurality of gray voltages on the basis of the reference voltage CVDD. The elements performing a function similar to those shown FIG. 2 are represented by the same numerals, and the descriptions thereof are omitted.

The reference voltage generator 120 includes a voltage divider connected between a gate-on voltage Von and a predetermined voltage such as a ground voltage and including a pair of resistors R15 and R17 and a variable resistor R16 connected therebetween, and a transistor Q1 having a base connected to a node between the resistors R15 and R16, a collector connected to a supply voltage AVDD, and an emitter connected to the common voltage generator 200 and the gray voltage generator 300. The resistance of the variable resistor R16 is adjustable by the user's selection.

In this LCD, the magnitude of the base voltage $V_B$ of the transistor Q1 is determined by Equation 1:

$$V_B = \frac{R_{16} + R_{17}}{R_{15} + R_{16} + R_{17}} V_{ON}; \quad \text{(Equation 1)}$$

and the magnitude of a reference voltage CVDD is determined by Equation 2:

$$CVDD = V_B - V_{BE} < AVDD, \quad \text{(Equation 2)}$$

where $V_{BE}$ is a base-emitter voltage of the transistor Q1.

Accordingly, the magnitude of the reference voltage CVDD is changed by manually adjusting the resistance of the variable resistor R16, thereby varying the magnitudes of the gray voltages.

Figure 6:
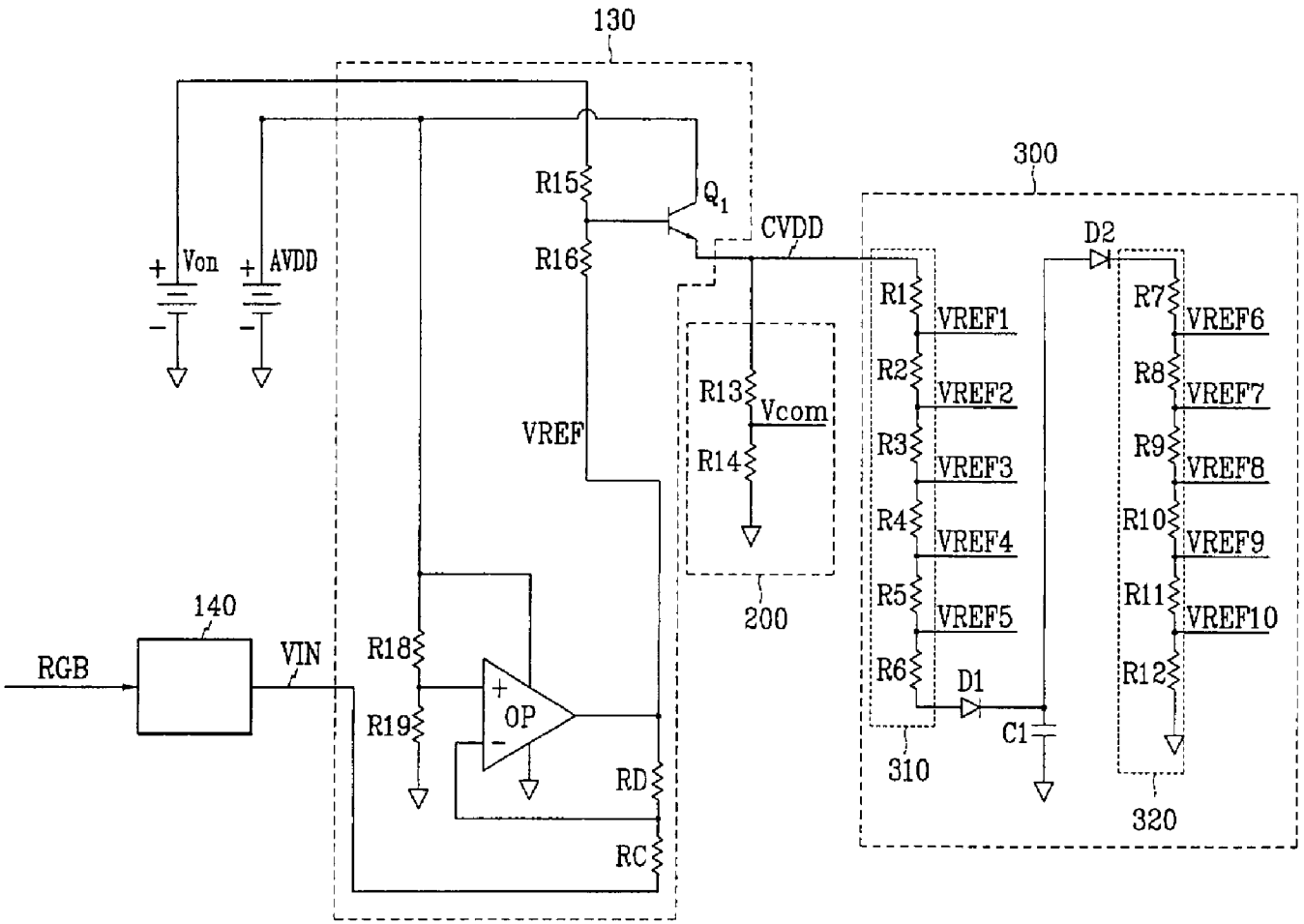
FIG. 6 is a circuit diagram of a gray voltage generator of an LCD according to another embodiment of the present invention.

FIG. 6 is a circuit diagram of an exemplary LCD according to another embodiment of the present invention, which varies the magnitudes of gray voltages depending on the brightness level of on-screen images.

With reference to FIG. 6, an LCD according to another embodiment of the present invention includes a screen brightness determining unit 140 determining the brightness level of on-screen images and generating an adjustment voltage VIN depending on the determined brightness level, a reference voltage generator 130 generating a reference voltage CVDD based on the adjustment voltage VIN, a common voltage generator 200 generating a common voltage Vcom on the basis of the reference voltage CVDD, and a gray voltage generator 300 generating a plurality of gray voltages on the basis of the reference voltage CVDD. The elements performing a function similar to those shown FIG. 2 are represented by the same numerals, and the descriptions thereof are omitted.

Referring to FIG. 6, the reference voltage generator 130 includes an operational amplifier OP with an input resistor RC and a feedback resistor RD, a voltage divider including a pair of resistors R18 and R19 connected in series between a supply voltage AVDD and a predetermined voltage such as a ground voltage, another voltage divider including a pair of resistors R15 and R16 connected in series between a gate-on voltage Von and the output of the amplifier OP, and a transistor Q1 having a base connected to the voltage divider R15 and R16, a collector connected to the supply voltage AVDD, and an emitter connected to the common voltage generator 200 and the gray voltage generator 300.

The amplifier OP is biased with the supply voltage AVDD and a predetermined voltage such as the ground voltage, and subject to negative feedback. The noninverting input terminal (+) of the amplifier OP is connected to the voltage divider R18 and R19.

In operation, the voltage divider R18 and R19 drops the magnitude of the supply voltage AVDD to provide for the noninverting terminal (+) of the amplifier OP. The amplifier OP amplifies the difference between the supply voltage AVDD and the adjustment voltage VIN to provide for the voltage divider R15 and R16. The voltage divider R15 and R16 drops the gate-on voltage Von inversely proportional to the magnitude of the output of the amplifier OP to provide for the base of the transistor Q1. The transistor Q1 drops the supply voltage AVDD approximately in proportion to its base voltage to output as the reference voltage CVDD though its emitter.

As a result, the magnitude of the reference voltage CVDD and thus the magnitudes of the gray voltages vary depending on the magnitude of the adjustment voltage VIN.

Now, detailed configurations of a screen brightness determining unit of an LCD according to embodiments of the present invention are described in detail.

According to an embodiment of the present invention, an adjustment voltage VIN is generated by RC filtering a PWM (pulse width modulation) signal with a duty width proportional to a mean value of the gray data for one frame. The adjustment voltage VIN is configured to be either proportional to or inversely proportional to a determined brightness level.

Figure 7:
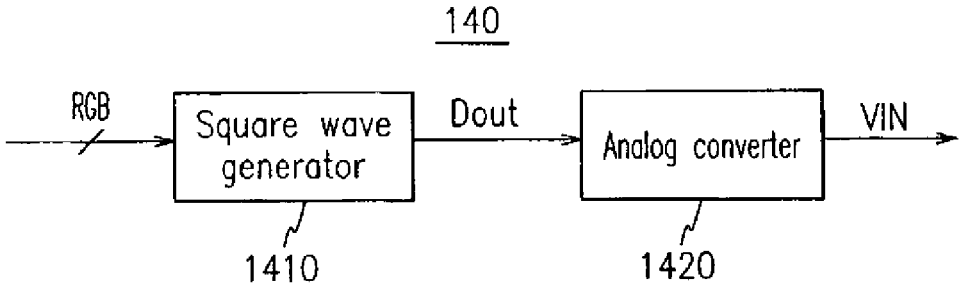
FIG. 7 is a block diagram of an exemplary screen brightness determining unit according to an embodiment of the present invention.

FIG. 7 is a block diagram illustrating an exemplary screen brightness determining unit of an LCD according to an embodiment of the present invention.

As shown in FIG. 7, a screen brightness determining unit 140 includes a square wave generator 1410, and an analog converter 1420.

The square wave generator 1410, provided with gray data R, G and B from a signal source, generates a duty signal Dout with a duty proportional to an average value of the gray data R, G and B for one row of pixels, i.e., for one horizontal time to provide for the analog converter 1420. The square wave generator 1410 may be provided within a signal controller (not shown) controlling the timing of the LCD.

For example, a 100% duty signal is generated when white gray data are input for one horizontal time, a 50% duty signal is generated when medium gray data are input for one horizontal time, and a 0% duty signal is generated when black gray data are input for one horizontal time. The square wave generator 1410 may be provided at the signal controller, or separated from the signal controller.

The analog converter 1420 analog-converts the duty signal into an adjustment voltage VIN to provide for the reference voltage generator 130. That is, the analog converter 1420 has a function of a digital-analog converter that receives and converts a square wave with a predetermined duty into an, analog adjustment voltage VIN.

Figure 8:
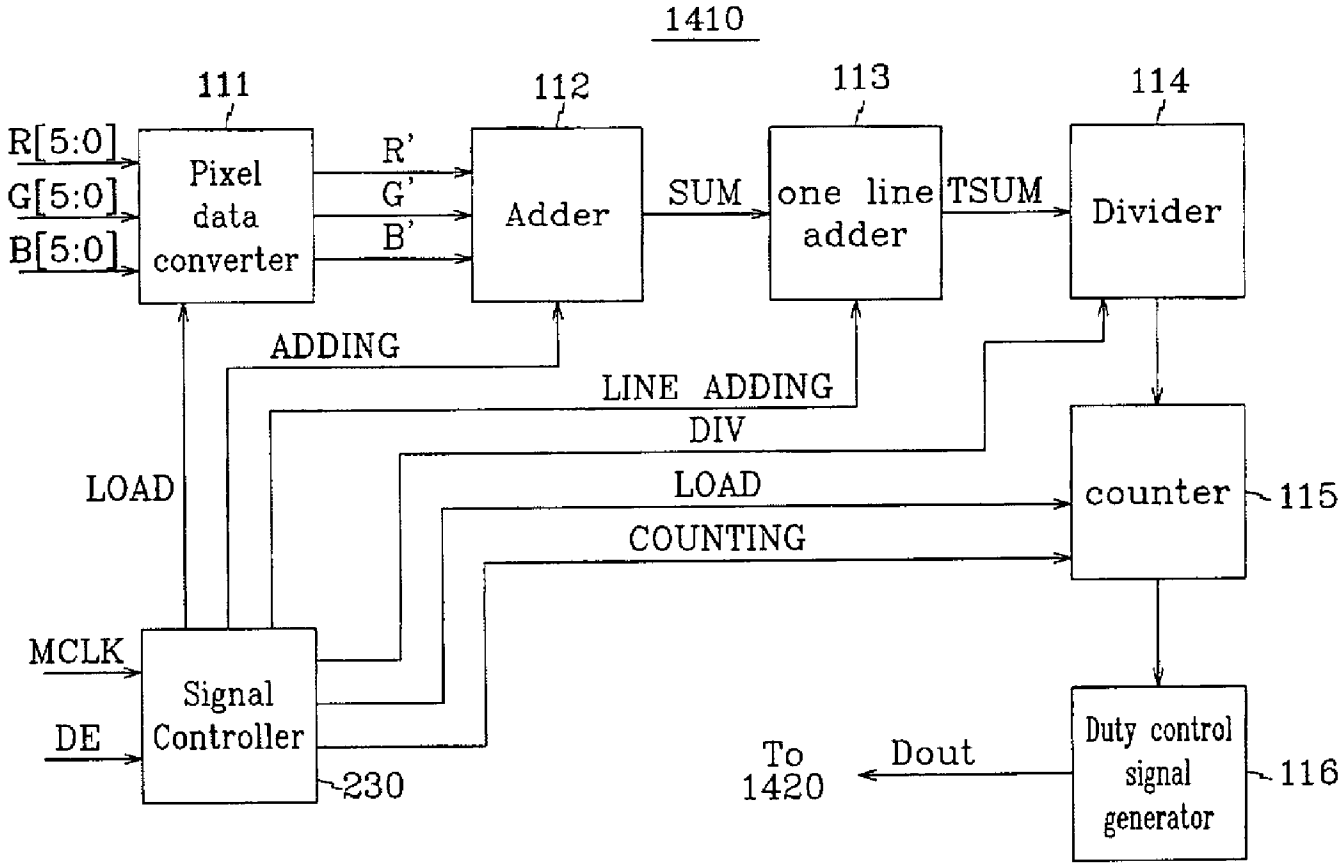
FIG. 8 is a block diagram of an exemplary square wave generator according to an embodiment of the present invention.

FIG. 8 is a block diagram illustrating an exemplary square wave generator of a brightness determining unit of an LCD according to an embodiment of the present invention.

As shown in FIG. 8, a square wave generator 1410 preferably integrated into a signal controller (not shown) includes a pixel data converter 111, an adder 112, a one-line adder 113, a divider 114, a counter 115, and a duty signal generator 116.

The signal controller provides a load signal LOAD, an adding signal ADDING, a line adding signal LINE ADDING, a dividing signal DIV, and a counting signal COUNTING.

The pixel data converter 111 receives R, G and B gray data from an external signal source, and assigns a predetermined weight to at least one of the gray data R, G and B based on the load signal LOAD from the signal controller. The pixel data converter 111 substitutes the remaining gray data (or datum) with the weighted gray datum (or data), and provides the substituted gray data and the weighted gray data for the adder 112 as converted gray data R', G' and B'. For example, if the R and B gray data are six bit data of '000000', the G gray datum is six bit datum of '111111' and weighted, the R', G' and B' gray data are '111111'. The assignment of weight may be omitted.

The adder 112 adds the converted gray data R', G' and B' based on the adding signal ADDING, and provides the sum SUM of the gray data R', G' and B' for the one line adder 113. For the above example, the sum SUM of the gray data R', G' and B' is '10111101.'

The one line adder 113 adds the sums SUM of the gray data R', G' and B' for one row of pixels based on the line adding signal LINE ADDING, and provides the one line sum TSUM of the sums SUM of the gray data R', G' and B' for the divider 114. For the above example with an XGA resolution with 1024 RGB pixels, the one line sum TSUM is an 18 bit datum of '101111010000000000.'

The divider 114 divides the one line sum TSUM by three based on the dividing signal DIV, and extracts top six bits (MSB) from the one line sum TSUM divided by three to provide for the counter 115. For the above example, the one line sum TSUM divided by three is '1111110000000000,' and the extracted six bit datum is '111111.'

The counter 115 provides a predetermined counted number for the duty signal generator 116 based on the extracted six-bit datum. The counter 115 includes a duty register (not shown) and a down counter (not shown). The duty register stores the extracted six-bit datum from the divider 114 upon receipt of the load signal LOAD. The down counter sequentially down-counts bits of the stored six bit datum on the basis of the counting signal COUNTING, and provides the down-counted number for the duty signal generator 116.

The duty signal generator 116 generates a duty signal Dout based on the down-counted number, and provides for the analog converter 1420.

Figure 9:
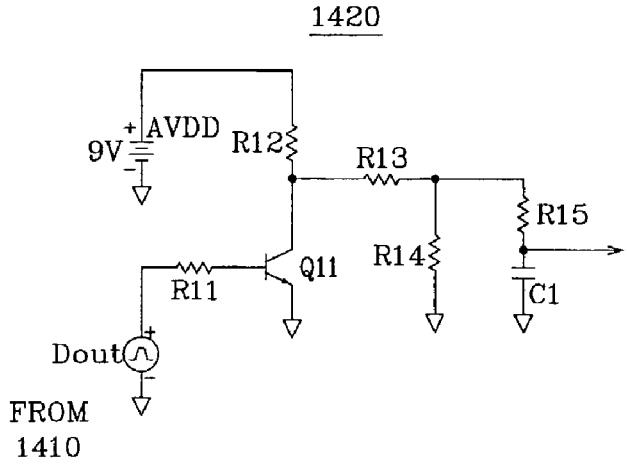
FIG. 9 is a circuit diagram of an exemplary analog converter according to an embodiment of the present invention.

FIG. 9 is an exemplary circuit diagram of an analog converter according to an embodiment of the present invention.

As shown in FIG. 9, an analogue converter according to an embodiment of the present invention includes a voltage divider having a plurality of resistors R12–R15, a transistor Q11 having a base with an input resistor R11 connected to the duty signal Dout, an emitter connected to a predetermined voltage such as a ground voltage and a collector connected to the supply voltage AVDD via the resistor R12, and a capacitor C1 connected between the resistor R15 and a predetermined voltage such as the ground voltage. The resistors R14 and R15 are connected in parallel to the resistor R13, which in turn is connected to the collector of the transistor Q11, and the resistor R14 is connected to a predetermined voltage such as the ground voltage. The output VIN of the analogue converter 1420 is connected to a node between the capacitor C1 and the resistor R15.

When the duty signal Dout is in the low level, the transistor Q11 is turned off so that the capacitor is charged. At this time, the voltage across the capacitor C1 is given by $$AVDD \cdot \frac{R14}{R12 + R13 + R14}.$$

On the contrary, when the duty signal Dout is in the high level, the first transistor Q11 is turned on so that the capacitor C1 is discharged.

The adjustment voltage VIN is determined by the time constant of the resistor R15 and the capacitor C1. That is, the adjustment voltage VIN is in proportion to the duty of the duty signal Dout and the number of pulses thereof.

Figure 10:
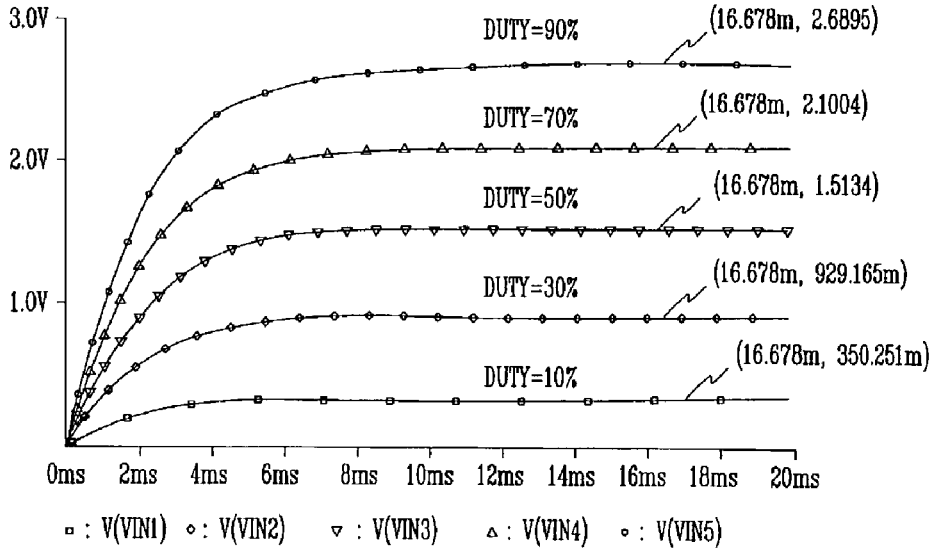
FIG. 10 is a graph showing a voltage across a liquid crystal capacitor as function of time for several duty rates according to an embodiment of the present invention.

FIG. 10 illustrates the adjustment voltage VIN as a function of time for several duty ratios of the duty signal Dout, where R11=20 kΩ, R12=1 kΩ, R13=1 kΩ, R14=1 kΩ, R15=20 kΩ, C1=0.1 μF, and AVDD=9V. The result was obtained by using PSPICE and the curves are obtained for 0%, 10%, 30%, 50%, 70% and 90% duty ratios.

As shown in FIG. 10, the adjustment voltage VIN reaches its maximum value after one frame period of about 16.6 ms. The time period for reaching the maximum value may be changed by adjusting the time constant, i.e., the values of R15 and C1 shown in FIG. 9.

Figure 11:
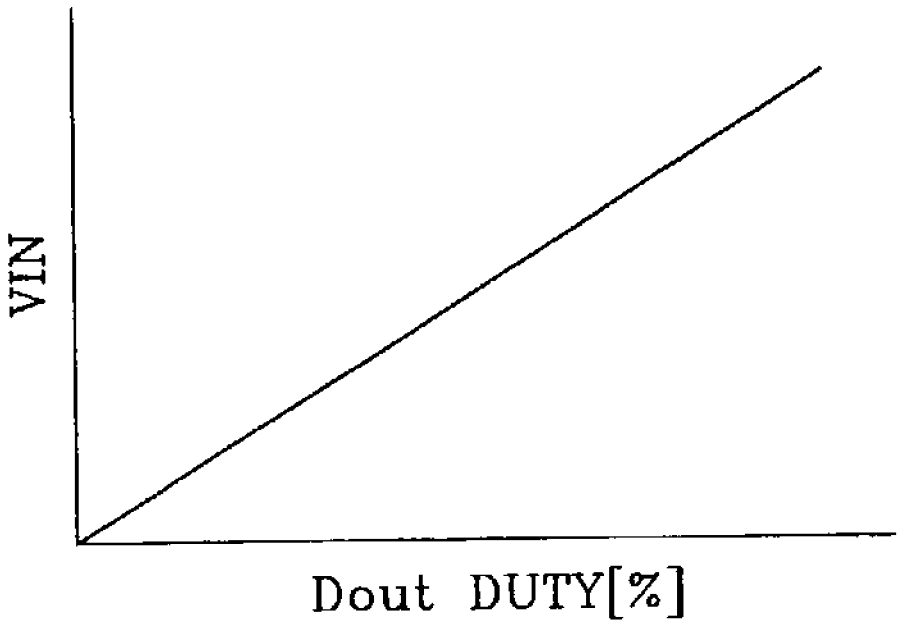
FIG. 11 shows an adjustment voltage as function of duty rates according to an embodiment of the present invention.

FIG. 11 shows the adjustment voltage VIN as function of the duty ratio of the duty signal. The linear proportionality of the adjustment voltage VIN to the duty ratio of the duty signal Dout means that the analogue converter 1420 performs a function of a D/A converter converting the average gray data for a display screen into an analog voltage.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display comprising:

a reference voltage generator changing level of a first predetermined voltage based on a first signal to generate a reference voltage, the first signal varying depending on one of brightness of surroundings of the liquid crystal display, brightness of on-screen images of the liquid crystal display, and a users s manipulation; and a gray voltage generator generating a plurality of gray voltages with magnitudes depending on a magnitude of the reference voltage and a second predetermined voltage, wherein the reference voltage generator comprises resistor to change level of the first predetermined voltage based on the first signal.

2. The liquid crystal display of claim 1, further comprising:

a plurality of first signal lines, a plurality of second signal lines and a plurality of pixels connected to the first and the second signal lines; and a first driver selecting the gray voltages based on gray data from an external source to supply to the pixels via the first signal lines.

3. The liquid crystal display of claim 2, further comprising a second driver supplying second signals to the second signal lines, each pixel including a switching element connected to one of the first signal lines and one of the second signal lines and transmitting the gray voltages to the pixels under the control of the second signals.

4. The liquid crystal display of claim 3, wherein the reference voltage generator comprises a first voltage divider dropping level of a third predetermined voltage for turning on the switching elements to generate the first signal.

5. The liquid crystal display of claim 2, further comprising a common voltage generator generating a common voltage to be applied to the pixels, based on the reference voltage.

6. The liquid crystal display of claim 1, wherein the gray voltage generator comprises a voltage divider connected between the reference voltage and the second predetermined voltage.

7. The liquid crystal display of claim 6, wherein the voltage divider comprises first and second series of resistors connected in series, and the first series of resistors is connected to the reference voltage while the second series of resistors is connected to the second predetermined voltage, the magnitudes of the gray voltages determined by magnitudes of the reference voltage and the second predetermined voltage and resistances of the first and the second series of resistors.

8. The liquid crystal display of claim 7, wherein the reference voltage generator comprises a transistor having a first terminal coupled to the tat signal, a second terminal coupled to the first predetermined voltage, and a third terminal outputting the reference voltage.

* * * * *